US010334690B1

(12) United States Patent
Hsu et al.

(10) Patent No.: US 10,334,690 B1
(45) Date of Patent: Jun. 25, 2019

(54) DRIVING DEVICE AND DRIVING METHOD THEREOF

(71) Applicant: Au Optronics Corporation, Hsinchu (TW)

(72) Inventors: Meng-Nien Hsu, Tainan (TW); Yi-Jiun Tsai, Hsinchu (TW); Yi-Hao Wang, Hsinchu County (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 15/933,352

(22) Filed: Mar. 22, 2018

(30) Foreign Application Priority Data

Dec. 21, 2017 (TW) ..... 106145140 A

(51) Int. Cl.
*H05B 33/08* (2006.01)

(52) U.S. Cl.
CPC ..... *H05B 33/0884* (2013.01)

(58) Field of Classification Search
CPC .... H05B 33/02; H05B 33/08; H05B 33/0803; H05B 33/0884; H05B 37/02; H05B 37/0209; H05B 37/03; H05B 37/032; H05B 37/036
See application file for complete search history.

(56) References Cited

U.S. PATENT DOCUMENTS 8,928,231 B2 1/2015 Campos et al.
9,253,838 B2 * 2/2016 Zhang ..... H05B 33/083
2010/0052572 A1 * 3/2010 Kataoka ..... H05B 33/0815 315/297
2010/0327772 A1 * 12/2010 Lee ..... H05B 33/0818 315/297
2011/0175547 A1 * 7/2011 Oh ..... H05B 33/0827 315/294
2013/0015780 A1 * 1/2013 Gao ..... H05B 33/0815 315/250
2013/0050288 A1 2/2013 Kang et al.
2013/0099684 A1 * 4/2013 Cheng ..... H05B 33/0818 315/186
2013/0169190 A1 * 7/2013 Fujita ..... G09G 3/342 315/307
2016/0135262 A1 * 5/2016 Murakami ..... H05B 33/0815 315/186

(Continued)

FOREIGN PATENT DOCUMENTS

TW 201521512 6/2015
TW I594660 8/2017

*Primary Examiner* — Jason Crawford
(74) *Attorney, Agent, or Firm* — JCIPRNET

(57) ABSTRACT

A driving device and a driving method are provided. The driving device includes at least one driving signal generator, respectively coupled to at least one light emitting diode string, respectively, and respectively generates at least one driving signal to drive the light emitting diode string. At least one detection device is coupled to a detection point of the respective light emitting diode string and the respective driving signal generator, and compares the detection voltage of the corresponding light emitting diode string on the detection point with the detected voltages on the detection points of a plurality of remaining light emitting diode strings. Each of the driving signal generators determines whether to generate the driving signal according to the detection result of the corresponding detection device.

14 Claims, 5 Drawing Sheets

(56) References Cited

U.S. PATENT DOCUMENTS

| | | | | |
|---|---|---|---|---|
| 2016/0143096 | A1* | 5/2016 | Lin | H05B 37/02 315/121 |
| 2016/0302269 | A1 | 10/2016 | Kanemitsu et al. | |
| 2017/0295632 | A1* | 10/2017 | Sun | H05B 37/02 |
| 2017/0374713 | A1* | 12/2017 | Liu | G05F 1/40 |
| 2018/0160516 | A1* | 6/2018 | Kwak | H05B 41/282 |

* cited by examiner

DRIVING DEVICE AND DRIVING METHOD THEREOF

CROSS-REFERENCE TO RELATED APPLICATION

This application claims the priority benefit of Taiwan application serial no. 106145140, filed on Dec. 21, 2017. The entirety of the above-mentioned patent application is hereby incorporated by reference herein and made a part of this specification.

BACKGROUND OF THE INVENTION

1. Field of the Invention

The invention relates to a driving device, and more particularly, to a driving device and a driving method thereof that can stop generating a driving signal for a light emitting diode string when detecting that at least one group of the light emitting diode strings among multiple groups of light emitting diode strings is damaged.

2. Description of Related Art

With the advancement of semiconductor technology, traditional lighting equipments have been gradually replaced by light emitting diodes (LEDs) for generating illumination light sources. Owing to advantages of power saving, long lifetime, small volume and high reliability, the light emitting diodes have become a lighting device that can take both power saving and environmental protection into consideration.

In general, during factory processing or assembly, a light emitting diode string is prone to issues of electrostatic discharge (ESD) or electrical over stress (EOS) caused by factors like the assembly environment, which leads to damages on part of the light emitting diode strings before shipment. Moreover, if aforesaid issues occur when a group of light emitting diodes are already assembled onto an lighting equipment, it is difficult for staff members to detect the light emitting diodes one by one because the time consumed by doing so can seriously affect the subsequent production progress. Therefore, finding a way to effectively detect the malfunction light emitting diodes for subsequent maintenance and replacement is the problem to be addressed by persons skilled in the art.

SUMMARY OF THE INVENTION

The invention provides a driving device and a driving method thereof that can stop generating a driving signal for a light emitting diode string when detecting that at least one of the light emitting diode strings among multiple groups of light emitting diode strings is damaged.

The driving device of the invention includes at least one driving signal generator, respectively coupled to at least one light emitting diode string, and respectively generating at least one driving signal to drive the light emitting diode strings, respectively. At least one detection device is coupled to a detection point of the respective light emitting diode string and respectively coupled to the driving signal generators. The respective detection device compares a first detection voltage on the detection point of a corresponding first light emitting diode string with a plurality of second detection voltages on the detection points of a plurality of remaining second light emitting diode strings to generate a detection result. The respective driving signal generator determines whether to stop generating the respective driving signal according to the detection result generated by the corresponding detection device.

The driving method of the invention is adapted to drive at least one light emitting diode string, and includes: respectively generating at least one driving signal to drive the light emitting diode strings, respectively, and generating a plurality of detection voltages on a plurality of detection points of the light emitting diode strings; comparing a first detection voltage among the detection voltages with a plurality of remaining second detection voltages among the detection voltages to generate a detection result of the light emitting diode string corresponding to the first detection voltage; and determining whether to stop generating the driving signal of the corresponding light emitting diode string according to the detection result corresponding to the first detection voltage.

Based on the above, it is known that, when the driving signal generator transmits the driving signal to one or more light emitting diode strings in the driving device, the light emitting diode strings are prone to damages caused by factors like the assembly environment. When aforesaid situation does occur, the invention can be used to conduct detections on the light emitting diode string by utilizing one or more detection devices and respectively generate the detection voltages at the time. Besides, the detection device further compares the detection voltage of the light emitting diode string under detection with the detection voltages of the remaining light emitting diode strings to generate a detection result. Accordingly, the driving signal generator may be utilized to determine whether to stop transmitting the driving signal to the damaged light emitting diode string according to the detection result.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
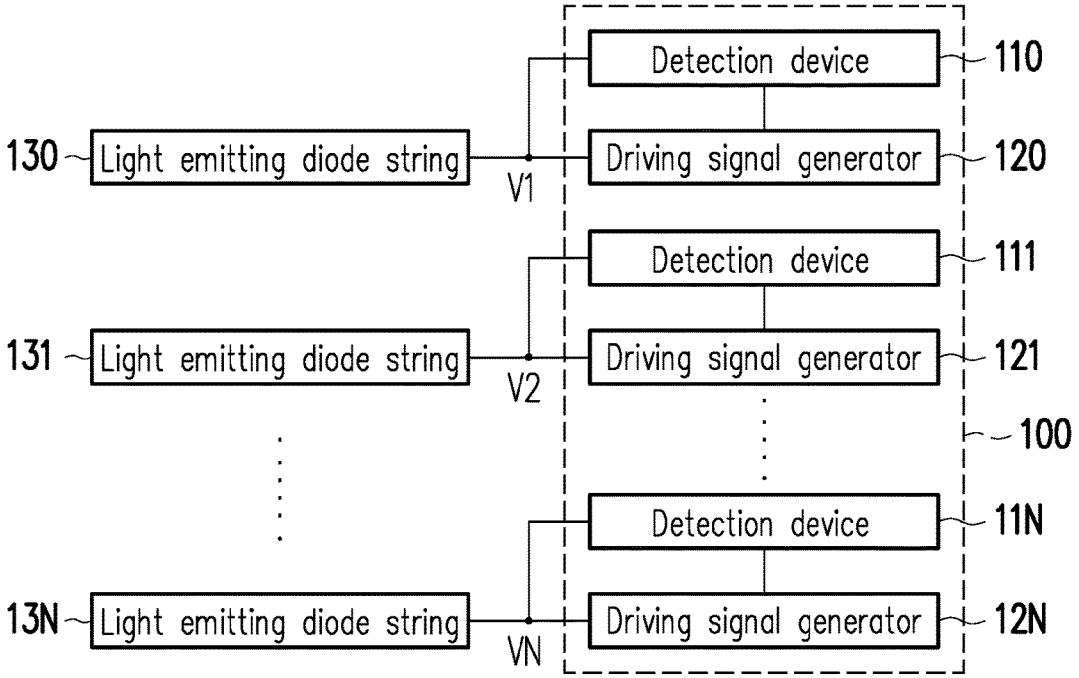
FIG. 1 is a schematic diagram illustrating a driving device according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

With reference to FIG. 1, FIG. 1 is a schematic diagram illustrating a driving device according to an embodiment of the invention. A driving device 100 includes detection devices 110 to 11N, and driving signal generators 120 to 12N. The driving device 100 may be coupled to each of light emitting diode strings 130 to 13N. In the present embodiment, the driving signal generators 120 to 12N may be respectively coupled to the light emitting diode strings 130 to 13N and may respectively generate a plurality of driving signals to drive the light emitting diode strings 130 to 13N, respectively, so as to turn on the light emitting diode strings 130 to 13N. On the other hand, each of the detection devices 110 to 11N may be coupled between a detection point of respective one of the light emitting diode strings 130 to 13N and respective one of the driving signal generators 120 to 12N so as to generate a detection result by detecting an operating state of each of the light emitting diode strings 130 to 13N and transmit the detection result to the driving signal generators 120 to 12N. Here, detection voltages V1 to VN are provided on the detection points of the light emitting diode strings 130 to 13N, respectively. The detection devices 110 to 11N may be used to further determine whether the light emitting diode strings 130 to 13N are in an abnormal state according to the detection voltages V1 to VN. It is noted that, the detection devices 110 to 11N, the driving signal generators 120 to 12N and the light emitting diode strings 130 to 13N in the present embodiment (where N is a positive integer) may be one or more, and their numbers thereof are not particularly limited.

The following description is described using the light emitting diode string 131 as an example. With reference to FIG. 1, in the driving device 100, the detection device 111 compares a detection voltage V2 on the detection point of the light emitting diode string 131 with the detection voltages on the detection points of the other light emitting diode strings 130 and 130N to generate a detection result. Also, the driving signal generator 121 may determine whether to stop generating the driving signal according to the detection result generated by the corresponding detection device 111. In other words, the driving signal generator 121 may determine whether the light emitting diode string 131 is in the abnormal state according to the detection result generated by the detection device 111. If the light emitting diode string 131 under detection is in the abnormal state, the light emitting diode string 131 is stopped from being driven so the light emitting diode string 131 is turned off. Conversely, if the light emitting diode string 131 under detection is not in the abnormal state, the light emitting diode string 131 stays being turned on.

The detection device 111 obtains the detection result through a comparison performed by subtracting the detection voltage V2 of the detection point of the light emitting diode string 131 under detection from the detection voltages (V1 and VN) on the detection points of both the other light emitting diode strings 130 and 130N. If none of voltage differences obtained by subtracting the detection voltage V2 from the detection voltages V1 and VN is greater than a predetermined threshold, it means that the light emitting diode string 131 is not in the abnormal state. Otherwise, if at least one of the differences obtained by subtracting the detection voltage V2 from the detection voltages V1 and VN is greater than the predetermined threshold, it means that the light emitting diode string 131 is in the abnormal state.

In addition, the detection device 111 may generate a plurality of logic values by detecting whether the voltage differences obtained by subtracting the detection voltage V2 from the detection voltages V1 and VN on the detection points of the other light emitting diode strings 130 and 13N, and perform an OR operation on the logic values to generate the detection result. In other words, when the voltage difference obtained by subtracting the detection voltage V2 from one detection voltage is greater than the predetermined threshold, the detection device 111 may generate the detection result indicating that the light emitting diode string 131 is abnormal.

Figure 2A:
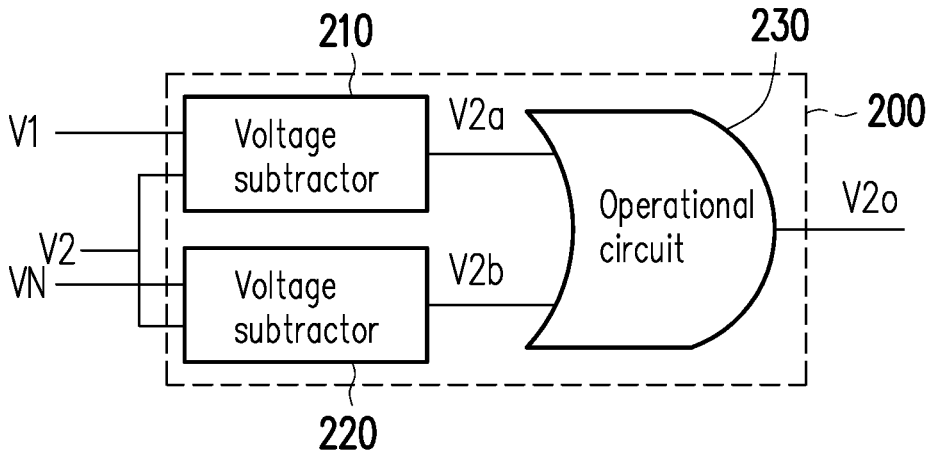
FIG. 2A is a schematic diagram illustrating a detection device of FIG. 1 according to an embodiment of the invention.

With reference to FIG. 2A, FIG. 2A is a schematic diagram illustrating a detection device of FIG. 1 according to an embodiment of the invention. A detection device 200 includes voltage subtractors 210 and 220 and an operational circuit 230. Output terminals of the voltage subtractors 210 and 220 may receive the detection voltages V1 and VN from the light emitting diode strings 130 and 13N, respectively, and may be used to calculate voltage differences among the detection voltages V1 and VN and determine whether the voltage differences are greater than a predetermined threshold to generate an output signal. On the other hand, an output terminal of the operational circuit 230 may be coupled to the voltage subtractors 210 and 220 to receive the output signals, and may perform an OR logical operation according to the output signals to generate the corresponding detection result.

Figure 2B:
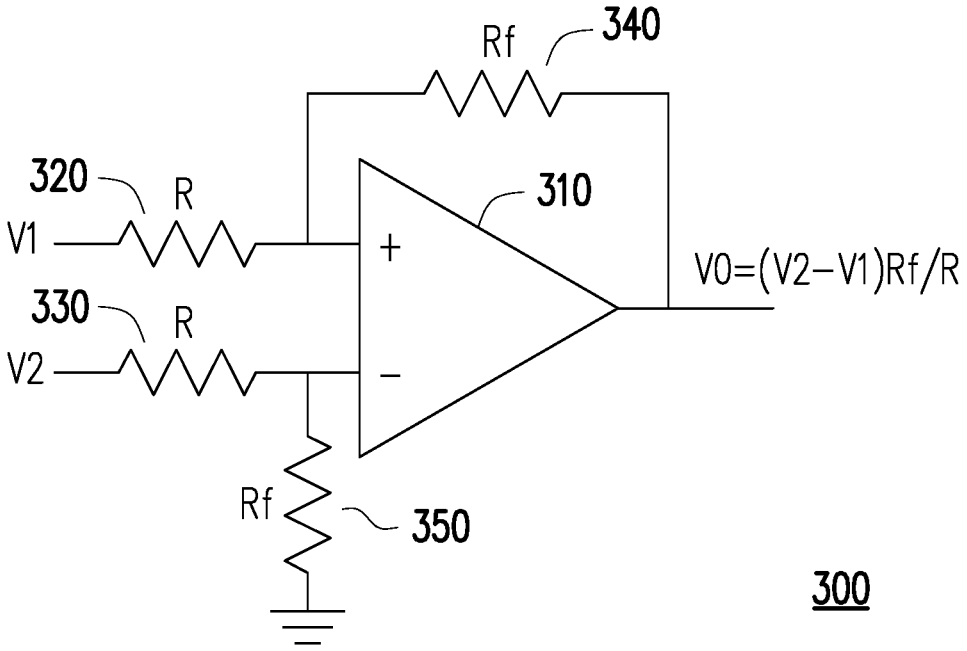
FIG. 2B is a schematic circuit diagram illustrating a voltage subtractor of FIG. 2A according to an embodiment of the invention.

In the present embodiment, the voltage subtractors 210 and 220 may be the same circuit of a voltage subtractor 300 in FIG. 2B of the invention, or may be a voltage subtractor well-known by persons skilled in the art. Detailed operating method of the voltage subtractor 300 in FIG. 2B will be described later.

On the other hand, the operational circuit 230 may be, for example, an OR gate or a combinational logic circuit constituted by one or more logic gates of any types, but not limited thereto. It should be noted that, the detection device 200 in FIG. 2A may be used to realize any one of the driving signal generators 120 to 12N in FIG. 1. It is to be noted that, the following description is also described using the light emitting diode string 131 as an example.

Working details regarding the driving device 100 may refer to FIG. 1 and FIG. 2A together. The voltage subtractor 210 may receive the detection voltages V1 and V2 from the light emitting diode strings 130 and 131. The detection device 200 may generate an output signal V2*a* by subtracting the detection voltage V2 under detection from the detection voltage V1 through the voltage subtractor 210. On the other hand, the voltage subtractor 220 may receive the detection voltages V2 and VN from the light emitting diode strings 131 and 13N. The detection device 200 may generate an output signal V2*b* by subtracting the detection voltage V2 under detection from the detection voltage VN through the voltage subtractor 220. It should be noted that, the output terminal of the operational circuit 230 may receive the output signals V2*a* and V2*b*, and determine whether the light emitting diode string 131 under detection is abnormal according to the output signals V2*a* and V2*b* so as to output a corresponding detection result V2*o*.

In detail, after the detection device 200 calculates the voltage difference between the detection voltage V1 and the detection voltage V2 (e.g., by subtracting the detection voltage V2 under detection from the detection voltage V1) through the voltage subtractor 210 and calculate the voltage difference between the detection voltage V2 and the detection voltage VN (e.g., by subtracting the detection voltage V2 under detection from the detection voltage VN) through the voltage subtractor 220, if at least one of voltage values of the output signals V2*a* and V2*b* is greater than a predetermined threshold, it means that a voltage value of the detection voltage V2 in the light emitting diode string 131 under detection is different from voltage values of the detection voltages V1 and VN in the light emitting diode strings 130 and 13N, and it can be further determined that the light emitting diode string 131 under detection may be in a damaged state. In this case, the operational circuit 230 may generate the detection result V2*o* indicating that the corresponding light emitting diode 131 is in the abnormal state according to the output signals V2*a* and V2*b*. In other words, when the driving signal generator 121 receives the detection result V2*o* indicating that the corresponding light emitting diode string 131 is abnormal, the driving signal generator 121 stops generating the corresponding driving signal so the light emitting diode string 131 under detection is turned off.

Conversely, if none of the voltage values of the output signals V2*a* and V2*b* is greater than the predetermined threshold, it means that the voltage values of the detection voltage V2 in the light emitting diode string 131 under detection and the detection voltages V1 and VN in the light emitting diode strings 130 and 13N are close to each other. In other words, the light emitting diode string 131 under detection is not in the abnormal state. The driving signal generator 121 may continue to generate the driving signal so the light emitting diode string 131 under detection can stay being turned on. It should be noted that, the predetermined threshold in the present embodiment may be, for example, 0.5V, but not limited thereto.

The following description refers to both FIG. 2A and FIG. 2B, where FIG. 2B is a schematic circuit diagram illustrating a voltage subtractor of FIG. 2A according to an embodiment of the invention. The voltage subtractor 300 includes an operational amplifier 310 and resistors 320 to 350. Among them, a first terminal of the resistor 320 may receive one of a plurality of detection voltages V1 to VN (e.g., receive the detection voltage V1), and a second terminal of the resistor 320 may be coupled to a positive input terminal of the operational amplifier 310. A first terminal of the resistor 330 may receive one of the detection voltages V1 to VN under detection (e.g., receive the detection voltage V2), and a second terminal of the resistor 330 may be coupled to a negative input terminal of the operation amplifier 310. In addition, the resistor 340 is serially connected between the second terminal of the resistor 320 and an output terminal of the operational amplifier 310, and the resistor 350 is serially connected between the second terminal of the resistor 330 and a reference ground terminal GND. Further, the operational amplifier 310 may generate a corresponding output signal Vo according to the received detection voltages V1 and V2.

The following description is described using the voltage subtractor 300 with reference to the implementation of the voltage subtractor 210. In the case as described above, the voltage difference generated by subtracting the detection voltage V2 from the detection voltage V1 may be calculated through the voltage subtractor 300. When resistances of the resistor 320 and the resistor 330 are identical and resistances of the resistor 340 and the resistor 340 are also identical, the output signal Vo of the operational amplifier 310=(V1−V2)×Rf/R. However, if the resistances of the resistors 320 to 350 are not identical, it is required to moderately adjust the output signal Vo of the operational amplifier 310 according to the resistances of the resistors 320 to 350. It should be noted that, the detection voltages V1 and V2 in FIG. 2B may be any two detection voltages among the detection voltage V1 to VN in FIG. 1 without particular limitation.

Figure 3:
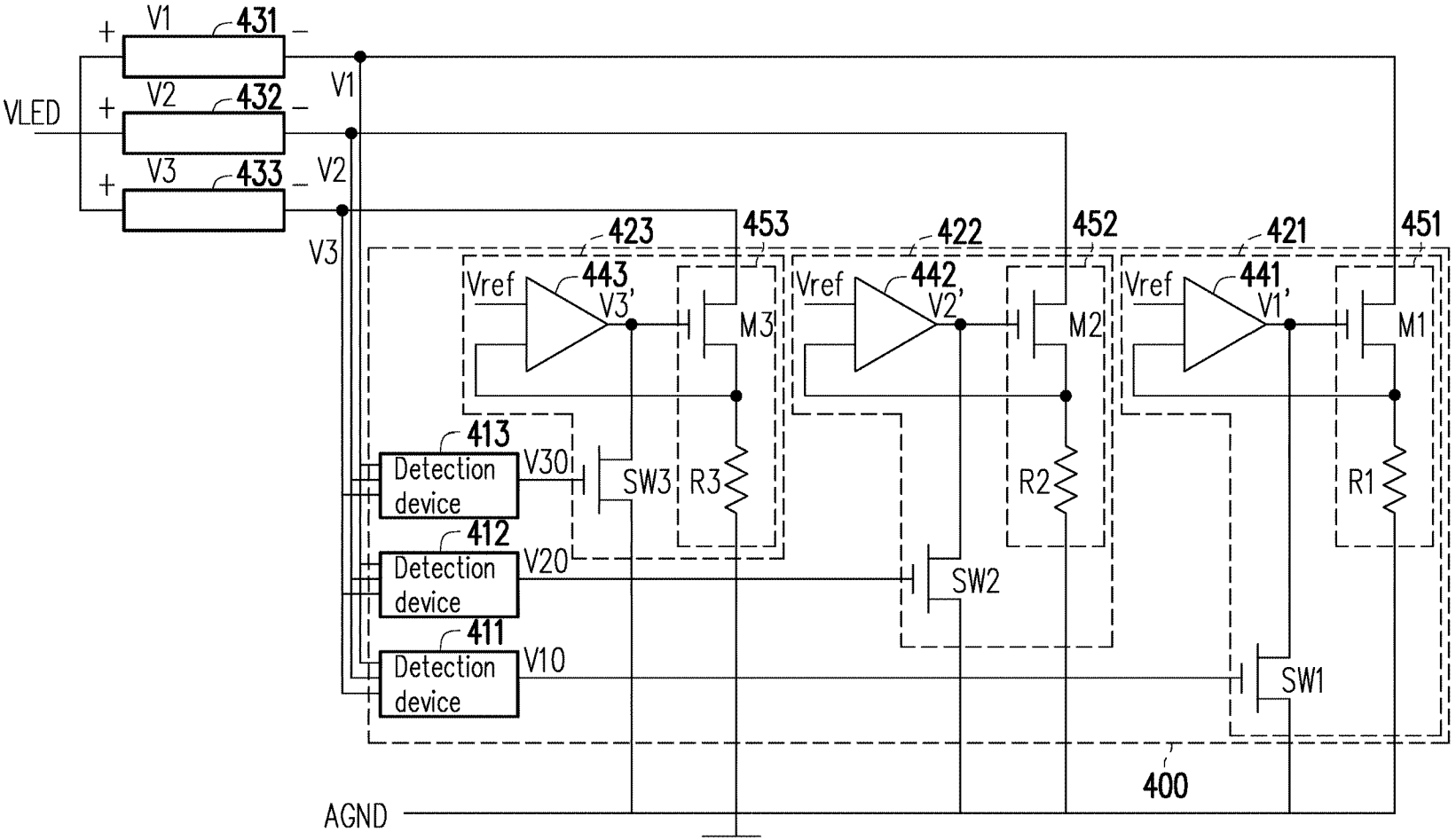
FIG. 3 is a schematic diagram illustrating a driving device according to another embodiment of the invention.

With reference to FIG. 3, FIG. 3 is a schematic diagram illustrating a driving device according to another embodiment of the invention. A driving device 400 includes detection devices 411 to 413 and driving signal generators 421 to 423. Here, the driving device 400 may be coupled to light emitting diode strings 431 to 433, respectively. It should be noted that, the driving signal generators 421 to 423 may include voltage followers 441 to 443, switch circuits SW1 to SW3 and current generators 451 to 453, respectively. In addition, the light emitting diode strings 431 to 433 may be controlled by a power voltage VLED.

In FIG. 3, the voltage followers 441 to 443 may include input terminals for receiving a reference voltage Vref, and includes output terminals for generating bias voltages V1' to V3'. The switch circuits SW1 to SW3 may be coupled to the output terminals of the voltage followers 441 to 443 to receive the bias voltages V1' to V3', respectively. The switch circuits SW1 to SW3 may determine whether to turn on or off the switch circuits SW1 to SW3 according to detection results V1*o* to V3*o* outputted by the detection devices 411 to 413, respectively. Besides, the current generators 451 to 453 may be coupled between respective one of the light emitting diode strings 431 to 433 and respective one of the switch circuits SW1 to SW3. The current generators 451 to 453 further include power amplifiers M1 to M3 (formed by transistors) and resistors R1 to R3, respectively.

On the other hand, first terminals of the power amplifiers M1 to M3 are coupled to the respective one of the light emitting diode strings 431 to 433 to provide the corresponding driving signals, respectively. In addition, control terminals of the power amplifiers M1 to M3 may be coupled to the switch circuits SW1 to SW3 to receive the bias voltages V1' to V3' via the switch circuits SW1 to SW3, respectively. Further, the resistors R1 to R3 may be coupled between respective one of the second terminals of the power amplifiers M1 to M3 and a reference ground voltage.

In the present embodiment, the switch circuits SW1 to SW3 may determine whether to provide the bias voltages V1' to V3' to the current generators 451 to 453 according to the detection results V1*o* to V3*o*, respectively. It should be noted that, when respective one of the current generators 451 to 453 receives respective one of the bias voltages V1' to V3', respective one of the current generators 451 to 453 may generate the corresponding driving signal according to respective one of the bias voltages V1' to V3' to drive respective one of the light emitting diode strings 431 to 433 so respective one of the light emitting diode strings 431 to 433 can be turned on. Conversely, when respective one of the current generators 451 to 453 does not receive respective one of the bias voltages V1' to V3', respective one of the current generators 451 to 453 stops generating the corresponding driving signal so respective one of the light emitting diode strings 431 to 433 is turned off.

Working details regarding the driving device 400 is described below with reference to the light emitting diode string 432 as an example. In detail, the driving device 400 receives the detection voltages V1 to V3 via the output terminal of the detection device 412, and is configured to calculate voltage differences between the detection voltage V2 under detection and the detection voltages V1 and V3. If one of said voltage differences is greater than a predetermined threshold (e.g., 0.5V), it means that the voltage value of the detection voltage V2 in the light emitting diode string 432 under detection is different from the voltage value of one of the detection voltage V1 and V3 in the light emitting diode strings 431 and 433, and it can be further determined that the light emitting diode string 432 may be in the damaged state. In this case, the detection device 412 generates a detection result V2*o* (e.g., logic high) indicating that the light emitting diode string 432 is abnormal. Accordingly, the switch circuit SW2 is turned on so the voltage value of the bias voltage V2' is pulled down to be equal to a reference ground voltage AGND. Meanwhile, the power amplifier M2 is turned off so the current generator circuit 452 stops generating and providing the driving signal to the light emitting diode 432 under detection. In other words, the current generator circuit 452 stops generating the driving signal corresponding to the light emitting diode string 432 according to the detection result V2*o* generated by the corresponding detection device 412 so the light emitting diode string 432 under detection is turned off.

Conversely, when none of the voltage differences between the detection voltage V2 under detection and the detection voltages V1 and V3 determined by the detection device 412 is greater than the predetermined threshold, it means that the voltage values of the detection voltage V2 in the light emitting diode string 432 under detection and the detection voltages V1 and V3 in the light emitting diode strings 431 and 433 are close to each other, and it can be further determined that the light emitting diode string 432 is not in the damaged state. In this case, the detection device 412 generates the detection result V2*o* (e.g., logic low) indicating that the light emitting diode string 432 is normal so the switch circuit SW2 is turned off to prevent the voltage value of the bias voltage V2' from being pulled down to be equal to the reference ground voltage AGND. Meanwhile, the power amplifier M2 may be turned on normally. In other words, the current generator circuit 452 may continue to generate the driving signal for the light emitting diode string 432 according to the detection result V2*o* generated by the corresponding detection device 412 so the light emitting diode string 432 under detection stays being turned on.

Figure 4:
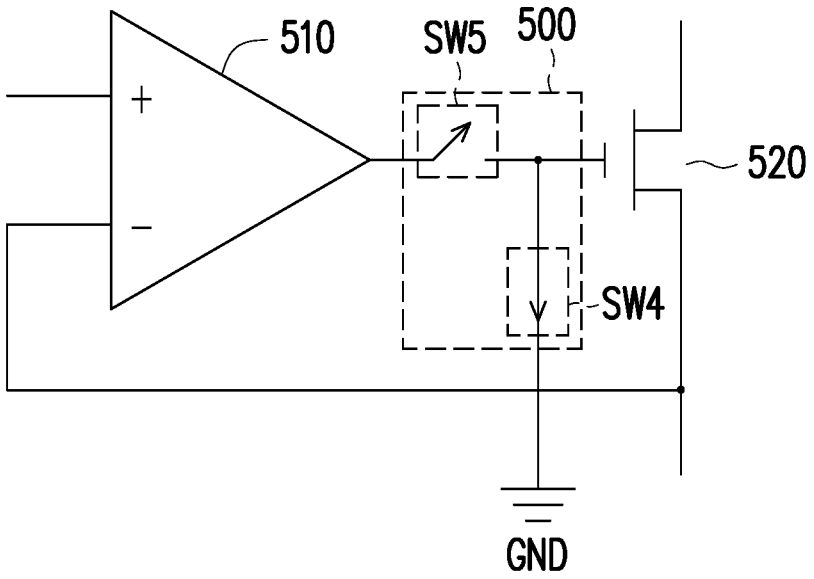
FIG. 4 is a schematic diagram illustrating a switch circuit of FIG. 3 according to another embodiment of the invention.

In the present embodiment, another implementation for the switch circuits SW1 to SW3 is further provided. The following description refers to FIG. 3 and FIG. 4 together, where FIG. 4 is a schematic diagram illustrating a switch circuit of FIG. 3 according to another embodiment of the invention. A switch circuit 500 includes a first switch SW4 and a second switch SW5. The first switch SW4 is coupled between a current generator 520 and a reference ground GND, and determines whether to turn on the first switch SW4 according to the corresponding detection result V2*o*. On the other hand, the second switch SW5 is coupled between an output terminal of a voltage follower 510 and the first switch SW4, and also determines whether to turn on the second switch SW5 according to the corresponding detection result V2*o*. Here, on/off states of the first switch SW4 and the second switch SW5 are opposite.

In detail, when the detection result outputted by the detection device corresponding to the switch circuit 500 indicates that the light emitting diode string under detection is in the damaged state, the first switch SW4 is turned on. Meanwhile, the second switch SW5 is turned off so the current generator 520 is cut off and the voltage follower 510 stops to operate, and thus the light emitting diode string under detection is turned off Conversely, when the detection result outputted by the detection device corresponding to the switch circuit 500 indicates that the light emitting diode string under detection is not in the damaged state, the first switch SW4 is turned off. Meanwhile, the second switch SW5 is turned on so the current generator 520 is turned on and the voltage follower 510 can continue to operate, and thus the light emitting diode string under detection can stay being turned on.

Figure 5:
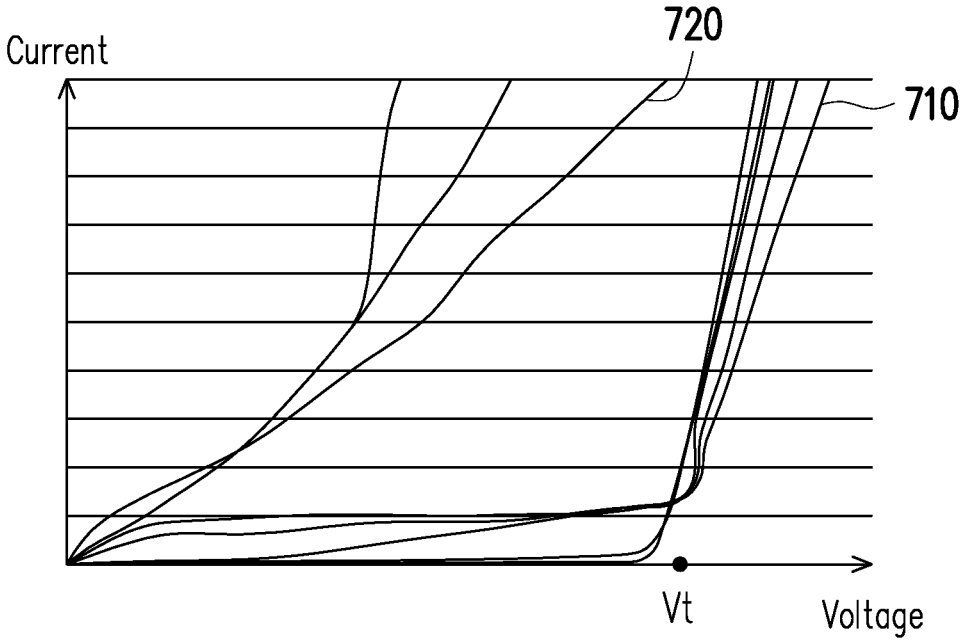
FIG. 5 illustrates a current-voltage graph of a light emitting diode string according to an embodiment of the invention.

FIG. 5 illustrates a current-voltage graph of a light emitting diode string according to an embodiment of the invention. In FIG. 5, the horizontal axis represents a voltage state of the light emitting diode string, and the vertical axis represents a current state of the light emitting diode string. Here, the current-voltage graph of the light emitting diode string includes a curve 710 representing the detection result when the light emitting diode string under detection is not in the abnormal state and a curve 720 representing the detection result when the test light emitting diode string is in the abnormal state. It should be noted that, in the present embodiment, driving signals less than a predetermined current are provided to a plurality of light emitting diode strings within a test time interval by utilizing a plurality of driving signal generators in a driving device, so as to detect whether the light emitting diode strings are in the abnormal state. Also, the detection devices generate the corresponding detection results within the test time interval. The predetermined current in the present embodiment may be set according to a current value generated when the light emitting diode string is biased to a threshold voltage Vt (e.g., to be less than the current value generated when the light emitting diode string is biased to the threshold voltage Vt). In the present embodiment, the respective driving signal generator makes the bias voltage received by the corresponding light emitting diode string less than the threshold voltage Vt of the corresponding light emitting diode string within the test time interval.

Figure 6:
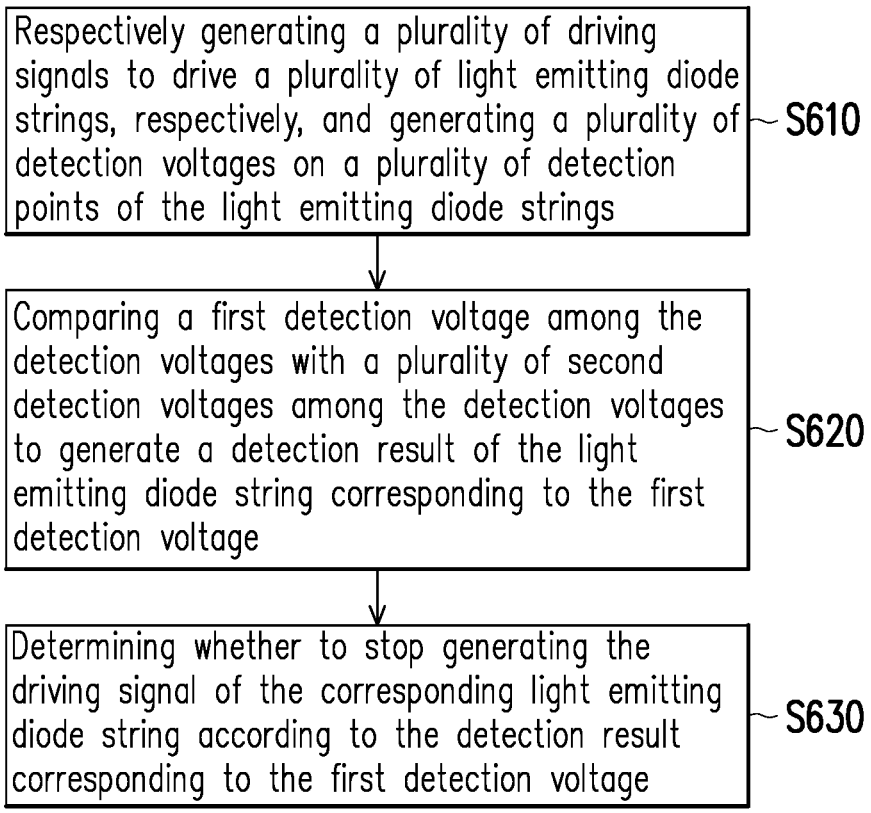
FIG. 6 is a flowchart illustrating a driving method of a driving device according to an embodiment of the invention.

FIG. 6 is a flowchart illustrating a driving method of a driving device according to an embodiment of the invention. In step S610, driving signal generators respectively generate a plurality of driving signals to drive light emitting diode strings, respectively, and generate a plurality of detection voltages on a plurality of detection points of the light emitting diode strings. In step S620, the detection device compares the detection voltage on the detection point of one specific light emitting diode string with the detection voltages on the detection points of the remaining light emitting diode strings to generate a detection result of the specific light emitting diode string corresponding to the detection voltage. In step S630, the respective driving signal generator determines whether to stop generating the driving signal of the specific light emitting diode string according to the detection result corresponding to the detection voltage.

Relevant implementation details regarding the steps above have been described in foregoing embodiments and implementations, which are not repeated hereinafter.

In summary, according to the embodiments of the invention, when the light emitting diode string is damaged in the driving device, the invention can utilize one or more detection devices to detect the light emitting diode strings and respectively generate the detection voltages at the same time. Besides, the detection device further compares the detection voltage of the light emitting diode string under detection with the detection voltages of the remaining light emitting diode strings to generate a detection result. Accordingly, the driving signal generator may be utilized to determine whether to stop transmitting the driving signal to the damaged light emitting diode string according to the detection result.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving device, comprising:

at least one driving signal generator, respectively coupled to at least one light emitting diode string, and respectively generating at least one driving signal to drive the light emitting diode strings, respectively;

at least one detection device, coupled to a detection point of the respective light emitting diode string and respectively coupled to the driving signal generators, and the respective detection device comparing a first detection voltage on the detection point of a corresponding first light emitting diode string with a plurality of second detection voltages on the detection points of a plurality of all remaining second light emitting diode strings to generate a detection result, wherein the respective driving signal generator determines whether to stop generating the respective driving signal according to the detection result generated by the corresponding detection device, wherein the respective detection device calculates a plurality of differences between the first detection voltage on the detection point of the corresponding first light emitting diode string and the second detection voltages on the detection points of the second light emitting diode strings, and the respective detection device generates the detection result indicating that the corresponding first light emitting diode string is abnormal when at least one of the differences is greater than a predetermined threshold, and each of the detection devices comprises:

a plurality of voltage subtractors, calculating the differences between the first detection voltage and the second detection voltages, and respectively generating a plurality of output signals according to whether the differences are greater than the predetermined threshold; and an operational circuit, coupled to the voltage subtractors, and performing an OR logical operation according to the output signals to generate the corresponding detection result.

2. The driving device according to claim 1, wherein the respective driving signal generator stops generating the corresponding driving signal when the respective driving signal generator receives the detection result indicating that the corresponding first light emitting diode string is abnormal.

3. The driving device according to claim 1, wherein each of the voltage subtractors comprises:

an operational amplifier, generating the corresponding output signal;

a first resistor, having a first terminal receiving the first detection voltage and a second terminal coupled to a positive input terminal of the operational amplifier;

a second resistor, having a first terminal receiving one of the second detection voltages, a second terminal of the second resistor being coupled to a negative input terminal of the operational amplifier;

a third resistor, serially connected between the second terminal of the first resistor and an output terminal of the operational amplifier; and a fourth resistor, serially connected between the second terminal of the second resistor and a reference ground terminal.

4. The driving device according to claim 3, wherein resistances of the first resistor and the second resistor are identical, and resistances of the third resistor and the fourth resistor are identical.

5. The driving device according to claim 1, wherein each of the driving signal generators comprises:

a voltage follower, having an input terminal for receiving a reference voltage, and having an output terminal for generating a bias voltage;

a switch circuit, coupled to the output terminal of the voltage follower to receive the bias voltage, and controlled by the corresponding detection result; and a current generator, coupled to the corresponding light emitting diode string and the switch circuit, wherein the switch circuit determines whether to provide the bias voltage to the current generator according to the detection result, the current generator generates the corresponding driving signal according to the bias voltage when the current generator receives the bias voltage, and the current generator stops generating the corresponding driving signal when the current generator does not receive the bias voltage.

6. The driving device according to claim 5, wherein the switch circuit comprises:

a first switch, coupled between the current generator and a reference ground terminal, and being turned on or off according to the corresponding detection result.

7. The driving device according to claim 6, wherein the switch circuit further comprises:

a second switch, coupled between the output terminal of the voltage follower and the first switch, and being turned on or off according to the corresponding detection result, wherein on/off states of the first switch and the second switch are opposite.

8. The driving device according to claim 5, wherein the current generator comprises:

a power amplifier, having a first terminal coupled to the corresponding light emitting diode string for providing the corresponding driving signal and a control terminal coupled to the switch circuit for receiving the bias voltage via the switch circuit; and a resistor, serially connected between a second terminal of the power amplifier and a reference ground voltage.

9. The driving device according to claim 1, wherein the driving signal generators provide the driving signals less than a predetermined current to the light emitting diode strings within a test time interval, and the respective detection device generates the corresponding detection result within the test time interval.

10. The driving device according to claim 9, wherein the respective driving signal generator makes the bias voltage received by the corresponding light emitting diode string less than a threshold voltage of the corresponding light emitting diode string within the test time interval.

11. A driving method, adapted to drive at least one light emitting diode string, and comprising:

respectively generating at least one driving signal to drive the light emitting diode strings, respectively, and generating a plurality of detection voltages on a plurality of detection points of the light emitting diode strings;

comparing a first detection voltage among the detection voltages with a plurality of all remaining second detection voltages among the detection voltages to generate a detection result of the light emitting diode string corresponding to the first detection voltage; and determining whether to stop generating the driving signal of the corresponding light emitting diode string according to the detection result corresponding to the first detection voltage, wherein a plurality of differences between the first detection voltage on the detection point of the corresponding first light emitting diode string and the second detection voltages on the detection points of the second light emitting diode strings are calculated by a plurality of voltage subtractors, and the detection result is generated by performing an OR logical operation by an operation circuit according to the output signals, and the detection result is used for indicating that the corresponding first light emitting diode string is abnormal when at least one of the differences is greater than a predetermined threshold.

12. The driving method according to claim 11, wherein the step of determining whether to stop generating the driving signal of the corresponding light emitting diode string according to the detection result corresponding to the first detection result comprises:

stopping generating the driving signal of light emitting diode string corresponding to the detection result when the detection result indicates that the corresponding first light emitting diode string is abnormal.

13. A driving device, comprising:

at least one driving signal generator, respectively coupled to at least one light emitting diode string, and respectively generating at least one driving signal to drive the light emitting diode strings, respectively;

at least one detection device, coupled to a detection point of the respective light emitting diode string and respectively coupled to the driving signal generators, and the respective detection device comparing a first detection voltage on the detection point of a corresponding first light emitting diode string with a plurality of second detection voltages on the detection points of a plurality of remaining second light emitting diode strings to generate a detection result, wherein the respective driving signal generator determines whether to stop generating the respective driving signal according to the detection result generated by the corresponding detection device, wherein the driving signal generators provide the driving signals less than a predetermined current to the light emitting diode strings within a test time interval, and the respective detection device generates the corresponding detection result within the test time interval.

14. A driving method, adapted to drive at least one light emitting diode string, and comprising:

respectively generating at least one driving signal to drive the light emitting diode strings, respectively, and generating a plurality of detection voltages on a plurality of detection points of the light emitting diode strings;

comparing a first detection voltage among the detection voltages with a plurality of all remaining second detection voltages among the detection voltages to generate a detection result of the light emitting diode string corresponding to the first detection voltage; and determining whether to stop generating the driving signal of the corresponding light emitting diode string according to the detection result corresponding to the first detection voltage, wherein the driving signals less than a predetermined current are provided to the light emitting diode strings within a test time interval, and the corresponding detection result is generated within the test time interval.

* * * * *